US006566850B2

(12) United States Patent
Heinrich

(10) Patent No.: US 6,566,850 B2
(45) Date of Patent: May 20, 2003

(54) LOW-VOLTAGE, LOW-POWER BANDGAP REFERENCE CIRCUIT WITH BOOTSTRAP CURRENT

(75) Inventor: Harley Kent Heinrich, Brewster, NY (US)

(73) Assignee: Intermec IP Corp., Woodland Hills, CA (US)

( * ) Notice: Subject to any disclaimer, the term of this patent is extended or adjusted under 35 U.S.C. 154(b) by 0 days.

(21) Appl. No.: 10/011,847

(22) Filed: Nov. 5, 2001

(65) Prior Publication Data

US 2002/0125874 A1 Sep. 12, 2002

Related U.S. Application Data

(60) Provisional application No. 60/251,636, filed on Dec. 6, 2000.

(51) Int. Cl.[7] ..... G05F 3/16; G05F 1/10

(52) U.S. Cl. ..... 323/313; 307/296.1; 327/539

(58) Field of Search ..... 323/313, 314, 323/315, 316, 317, 901, 907; 307/296.1, 296.6, 296.8; 327/538, 539, 540, 541, 543

(56) References Cited

U.S. PATENT DOCUMENTS 4,857,823 A * 8/1989 Bitting ..... 323/314
5,132,556 A 7/1992 Cheng
5,304,918 A * 4/1994 Khien ..... 323/315
5,508,604 A 4/1996 Keeth
5,545,978 A * 8/1996 Pontius ..... 323/313
5,818,292 A 10/1998 Slemmer
5,900,773 A 5/1999 Susak
5,961,215 A 10/1999 Lee et al.
6,002,242 A * 12/1999 Migtiavacca ..... 323/312
6,392,470 B1 * 5/2002 Burstein et al. ..... 327/539

* cited by examiner

*Primary Examiner*—Rajnikant B. Patel
(74) *Attorney, Agent, or Firm*—O'Melveny & Myers LLP

(57) ABSTRACT

A bandgap reference generator includes a bandgap reference circuit, a sensing circuit, and a current injector circuit. The bandgap reference circuit includes an input for receiving a supply voltage $V_{CC}$ and an output for providing a reference voltage $V_{REF}$. The bandgap reference circuit also has a first internal node with a first voltage and a second internal node with a second voltage. The sensing circuit is operatively coupled to the bandgap reference circuit for sensing the second voltage at the second node. The current injection circuit is responsive to the sensing circuit for injecting bootstrap current into the first internal node until the second voltage reaches a threshold voltage. The current injection circuit is operative to inject the bootstrap current into the first internal node during an initial condition of the bandgap reference circuit to cause the bandgap reference circuit to quickly transition to a desired operating state. The injection of bootstrap current is discontinued when the second voltage reaches the threshold voltage reflecting that the desired operating state is achieved.

23 Claims, 1 Drawing Sheet

LOW-VOLTAGE, LOW-POWER BANDGAP REFERENCE CIRCUIT WITH BOOTSTRAP CURRENT

RELATED APPLICATION DATA

This application claims priority pursuant to 35 U.S.C. §119(e) to U.S. Provisional Application No. 60/251,636, filed Dec. 6, 2000.

BACKGROUND OF THE INVENTION

1. Field of the Invention

The present invention relates to reference voltage supplies for complementary metal-oxide semiconductor (CMOS) circuitry, and more particularly, to a bandgap reference circuit having a bootstrap current generator circuit providing rapid initialization of the bandgap reference circuit.

2. Description of Related Art

Bandgap reference circuits are well known in the art of analog integrated circuit (IC) design for generating a reference voltage equal to the bandgap potential of silicon devices, which is approximately 1.2 volts. Conventional bandgap reference circuits are known to have two stable operating states as the power supply voltage to the circuit transitions from zero to a normal operational level. The first operating state corresponds to a desired mode of the circuit in supplying the reference voltage. The second operating state corresponds to an undesired mode of the circuit in which it remains shut down. A drawback of conventional bandgap reference circuits is that they tend to remain locked-up at the second operating state for an indeterminate period of time before transitioning to the first operating state. It is therefore desirable for many integrated circuit applications that the bandgap reference circuit transition to the first operating state as quickly as possible.

Various techniques are known for speeding the transition to the first operating state. One such technique is to inject a small amount of bootstrap current into the internal nodes of the circuit to prevent it from locking up in the undesired second operating state. For bandgap reference circuits that are supplied by a 3–5 volt power supply, the circuit can include additional transistors that cause the bootstrap current to be injected and then shut off once the first operating state is reached. Unfortunately, this technique is not effective with bandgap reference circuits supplied by a low voltage power supply (e.g., 1–1.5 volts), since the additional transistors in the reference circuit tend to prevent it from turning on. Another solution is to add a resistor leakage path into an internal node of the reference circuit. For low power operation, however, this resistor must be very large (e.g., greater than 10M Ω) and it also disturbs the operation of the reference circuit.

Accordingly, it would be very desirable to provide a bandgap reference circuit that overcomes these and other drawbacks of the prior art. More specifically, it would be desirable to provide a bandgap reference circuit that can generate bootstrap current for a power supply voltage ranging between 1–1.5 volts, and that can operate with very low power levels.

SUMMARY OF THE INVENTION

The present invention satisfies the need for a bandgap reference circuit that can transition quickly to a desired operational state by injecting bootstrap current into an internal node of the circuit. Unlike the prior art, the present bandgap reference circuit is effective with a low voltage power supply (e.g., 1–1.5 volts).

In accordance with an embodiment of the invention, a bandgap reference generator includes a bandgap reference circuit, a sensing circuit, and a current injector circuit. The bandgap reference circuit includes an input for receiving a supply voltage $V_{CC}$ and an output for providing a reference voltage $V_{REF}$. The bandgap reference circuit also has a first internal node with a first voltage and a second internal node with a second voltage. The sensing circuit is operatively coupled to the bandgap reference circuit for sensing the second voltage at the second node. The current injection circuit is responsive to the sensing circuit for injecting bootstrap current into the first internal node until the second voltage reaches a threshold voltage. When the second voltage reaches the threshold voltage, reflecting that the desired operating state is achieved, the bootstrap current is shut off.

More particularly, the bandgap reference circuit further includes two n-channel field effect transistors (NFETs) and two p-channel field effect transistors (PFETs). The two NFETs have respective gate terminals tied together at the first internal node and the two PFETs have respective gate terminals tied together at the second internal node. The sensing circuit further comprises a serial pair of inverter circuits adapted to change state at the threshold voltage. The current injection circuit further comprises a depletion field effect transistor (FET) having a source terminal connected to the output of the sensing circuit, and first and second p-channel field effect transistors (PFETs) having respective gate terminals tied together at a drain terminal of the depletion FET. A drain terminal of the second PFET is connected to the first internal node to provide the bootstrap current.

A more complete understanding of a low-voltage, low-power bandgap reference circuit with bootstrap current will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

Figure 1:
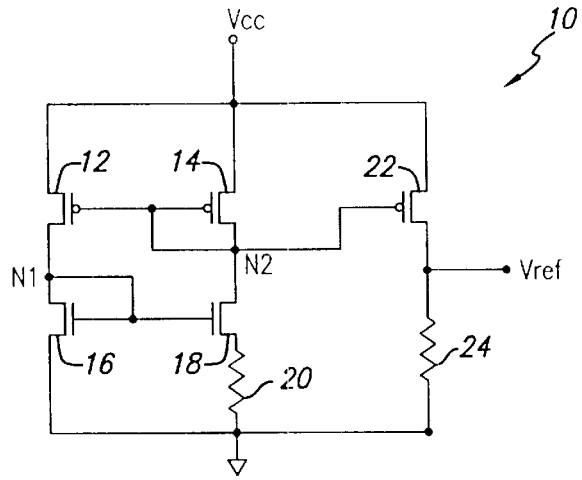
FIG. 1 PRIOR ART
FIG. 1 is a schematic diagram of a prior art bandgap reference circuit.

Referring first to FIG. 1, an exemplary bandgap reference circuit 10 is illustrated. The bandgap reference circuit 10 includes three current paths between the supply voltage ($V_{CC}$) and ground potential. The first current path includes P-channel field-effect transistor (PFET) 12 and N-channel field-effect transistor (NFET) 16. The second current path includes PFET 14, NFET 18, and resistor 20. The third current path includes PFET 22 and resistor 24. PFET 12 has its source connected to the supply voltage $V_{CC}$ and its drain connected to the drain of NFET 16. The commonly connected drains of PFET 12 and NFET 16 define a first internal node N1. The drain and gate of NFET 16 are connected together. The source of NFET 16 is coupled to ground potential. PFET 14 has its source connected to the supply voltage $V_{CC}$ and its drain connected to the drain of NFET 18. The commonly connected drains of PFET 14 and NFET 18 define a second internal node N2. The drain and gate of PFET 14 are connected together. The source of NFET 18 is coupled to ground potential through resistor 20. The gates of PFETs 12, 14 are tied together, as are the gates of NFETs 16, 18. PFET 22 has its source connected to the supply voltage $V_{CC}$, its drain connected to ground through resistor 24, and its gate tied to second internal node N2. The reference voltage ($V_{REF}$) is provided at an output of the bandgap reference circuit 10 that comprises the drain of PFET 22.

When the supply voltage $V_{CC}$ is zero, the voltages at nodes N1, N2 are also zero. As the bandgap reference circuit 10 is powered up and the supply voltage $V_{CC}$ is increased from zero, the voltages at nodes N1, N2 are at an indeterminate voltage state. If the voltage at node N1 remains low enough to turn off NFETs 16, 18, and the voltage at node N2 rises high enough to turn off PFETs 12, 14, then the bandgap reference circuit 10 assumes the second operating state in which it remains shut down. The rising supply voltage $V_{CC}$ tends to reinforce this undesirable state, since the voltage at node N2 rises due to the diode connection through PFET 14 to the supply voltage $V_{CC}$ leaving PFETs 12, 14 off, while node N1 remains near ground leaving NFETs 16, 18 off as well. On the other hand, if the voltage at node N1 rises high enough to turn on NFETs 16, 18, then NFET 18 will pull node N2 to a low enough voltage to turn on PFETs 12, 14, 22, and the bandgap reference circuit assumes the desirable first operating state. Similarly, if the voltage at node N2 remains low enough to turn on PFETs 12, 14, then PFET 12 will pull node N1 to a high enough voltage to turn on NFETs 16, 18, and the bandgap reference circuit assumes the desirable first operating state. The present invention resolves this uncertainty of the operating state upon power-up by adding a bootstrap current generator circuit to the conventional bandgap reference circuit.

Figure 2:
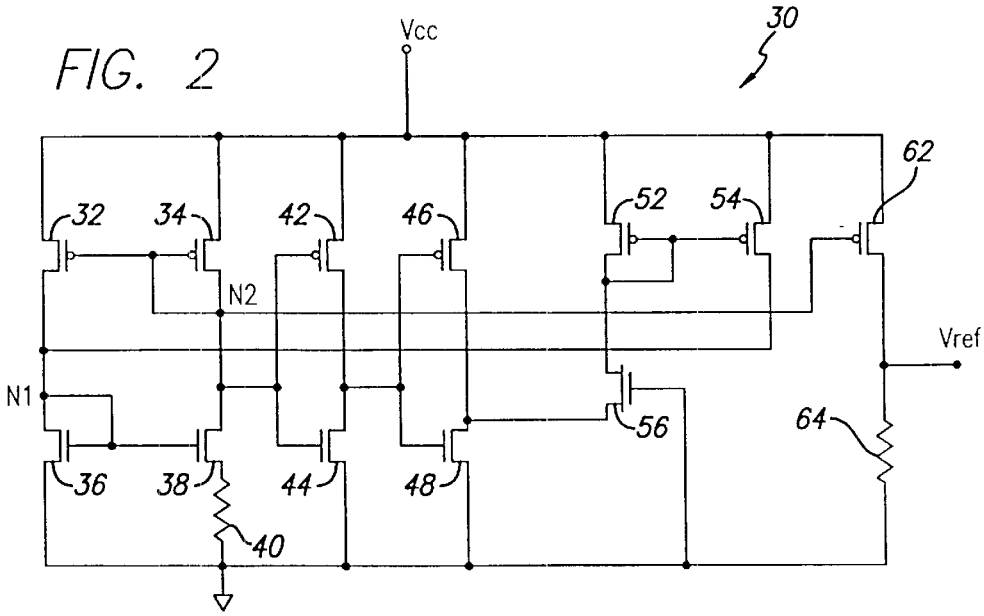
FIG. 2 is a schematic diagram of a bandgap reference circuit in accordance with an embodiment of the present invention.

Referring now to FIG. 2, a bandgap reference circuit 30 is shown in accordance with an embodiment of the present invention. The bandgap reference circuit 30 includes PFETs 32, 34, 62, NFETs 36, 38, and resistors 40, 64 corresponding generally to the conventional bandgap reference circuit described above with respect to FIG. 1. The bandgap reference circuit 30 further includes a first inverter provided by PFET 42 and NFET 44, a second inverter provided by PFET 46 and NFET 48, and a current injector circuit provided by PFETs 52, 54 and n-channel depletion FET 56. PFET 42 has its source connected to the supply voltage $V_{CC}$ and its drain connected to the drain of NFET 44. The gates of PFET 42 and NFET 44 are both connected to the second node N2. NFET 44 has its source connected to ground potential. PFET 46 has its source connected to the supply voltage $V_{CC}$ and its drain connected to the drain of NFET 48. The gates of PFET 46 and NFET 48 are both connected to the commonly coupled drains of PFET 42 and NFET 44. NFET 48 has its source connected to ground potential. PFETs 52, 54 both have their respective source connected to the supply voltage $V_{CC}$ and their respective gates are commonly coupled. The drain and gate of PFET 52 are connected together, and to the drain of depletion FET 56. The source of depletion FET 56 is connected to the commonly coupled drains of PFET 46 and NFET 48, and the gate of depletion FET 56 is connected to ground potential. The drain of PFET 54 is connected to the first internal node N1, and provides a bootstrap current path as will be further described below.

The stable first operating state of the bandgap reference circuit 30 is reached in accordance with the following equation:

$$I_{36}=(kT/qR)ln(A_{38}/A_{36})$$

wherein $I_{36}$ is the current through NFET 36, T is absolute temperature, k is Boltzman's constant, q is the charge of an electron, R is the resistance of resistor 40, and $A_{38}/A_{36}$ is the ratio of the gate area of NFETs 38, 36. The quantity kT/q is also known as the "volt-equivalent of temperature," and is commonly represented by $V_T$.

In a preferred embodiment of the present invention, PFET 42 and NFET 44 are selected to have a low threshold for sensing the voltage at internal node N2. As described above, when the bandgap reference circuit 30 is powering up, the voltage at internal node N2 tracks the level of the increasing supply voltage $V_{CC}$. Prior to the time the voltage at internal node N2 reaches the threshold, the inverter provided by PFET 42, NFET 44 is providing a high output voltage at the commonly coupled drains of PFET 42, NFET 44. The inverter output is in turn inverted by the second inverter provided by PFET 46, NFET 48, providing a ground potential output to the source of the depletion FET 56 that turns on the current injector circuit. The depletion FET 56 is held on by its gate coupled to ground potential, thereby pulling the commonly coupled gates of PFETs 52, 54 to ground causing them to turn on. The drain current of PFET 54 is injected back to internal node N1, thereby causing NFETs 36, 38 to turn on and transition the bandgap reference circuit 30 to the stable first operating state. When the voltage at internal node N2 reaches the threshold, both inverters change state causing the depletion FET 56 to shut off. This causes the voltage at the commonly coupled gates of PFETs 52, 54 to rise to their threshold voltage level and shut off, thereby shutting off the supply of injection current from PFET 54 to the internal node N1.

Accordingly, the initial default condition of the current injector circuit is to supply injection current to the internal node N1 of the bandgap reference circuit independent of the voltage at the internal node N2. Once the supply voltage $V_{CC}$ reaches a high enough voltage that the internal node N2 reaches the threshold, the first inverter recognizes this condition and switches state to shut off the injection current. As a result, the bandgap reference circuit will always transition quickly into the desired first operating state. The operating current and the threshold of the first inverter circuit is controlled by the absolute and relative sizes of PFET 42, NFET 44. The first inverter circuit only draws transient power when the gate changes state. The current injector circuit draws only the bootstrap current, which it mirrors and injects into the reference circuit. The only static operating current of this circuit, once the voltage at internal node N2 has reached its threshold, is from the low-threshold inverter circuit, and as a result this current can be made very small (e.g., less than 10 nA). Thus, the bootstrap circuit draws very little operating current and can be made to activate at lower supply voltages than traditional bootstrap circuits.

Having thus described a preferred embodiment of a low-voltage, low-power bandgap reference circuit with bootstrap current, it should be apparent to those skilled in the art that certain advantages have been achieved. It should also be appreciated that various modifications, adaptations, and alternative embodiments thereof may be made within the scope and spirit of the present invention. The invention is further defined by the following claims.

What is claimed is:

1. A bandgap reference generator for providing a reference voltage $V_{REF}$ from a supply voltage $V_{CC}$, said bandgap reference generator comprising:

a bandgap reference circuit having an input for receiving said supply voltage $V_{CC}$ and an output for providing said reference voltage $V_{REF}$, said bandgap reference circuit also having a first internal node with a first voltage and a second internal node with a second voltage;

a sensing circuit for sensing said second voltage at said second node; and a current injection circuit responsive to said sensing circuit for injecting bootstrap current into said first internal node until said second voltage reaches a threshold voltage, wherein said bootstrap current injected into said first internal node causes said bandgap reference circuit to quickly transition to a desired operating state from an initial condition and to discontinue injection of said bootstrap current when said second voltage reaches said threshold voltage reflecting that said desired operating state is achieved.

2. The bandgap reference generator of claim 1, wherein said bandgap reference circuit further includes two n-channel field effect transistors (NFETs) and two p-channel field effect transistors (PFETs), and wherein said two NFETs have respective gate terminals tied together at said first internal node and said two PFETs have respective gate terminals tied together at said second internal node.

3. The bandgap reference generator of claim 1, wherein said bandgap reference circuit includes multiple current paths, and wherein said first internal node is disposed on a first current path of said multiple current paths and said second internal node is disposed on a second current path of said multiple current paths.

4. The bandgap reference generator of claim 1, wherein said sensing circuit further comprises a first inverter circuit adapted to change state at said threshold voltage, said first inverter circuit having a first inverter output.

5. The bandgap reference generator of claim 4, wherein said first inverter circuit further comprises a first n-channel field effect transistor (NFET) and a first p-channel field effect transistor (PFET) having respective gate terminals tied together at said second internal node and respective drain terminals tied together at said first inverter output.

6. The bandgap reference generator of claim 4, wherein said sensing circuit further comprises a second inverter circuit coupled to said first inverter circuit, said second inverter circuit providing a second inverter output opposite said first inverter output.

7. The bandgap reference generator of claim 6, wherein said second inverter circuit further comprises a second n-channel field effect transistor (NFET) and a second p-channel field effect transistor (PFET) having respective gate terminals tied together at said first inverter output and respective drain terminals tied together at said second inverter output.

8. The bandgap reference generator of claim 1, wherein said current injection circuit further comprises a depletion field effect transistor (FET) having a source terminal connected to said sensing circuit, and first and second p-channel field effect transistors (PFETs) having respective gate terminals tied together at a drain terminal of said depletion FET, and wherein a drain terminal of said second PFET is connected to said first internal node to provide said bootstrap current.

9. The bandgap reference generator of claim 8, wherein said depletion FET further comprises an n-channel depletion FET.

10. The bandgap reference generator of claim 9, wherein a gate terminal of said depletion FET is connected to ground.

11. A bandgap reference generator for providing a reference voltage $V_{REF}$ from a supply voltage $V_{CC}$, said bandgap reference generator comprising:

a bandgap reference circuit having an input for receiving said supply voltage $V_{CC}$ and an output for providing said reference voltage $V_{REF}$, said bandgap reference circuit also having a first internal node with a first voltage and a second internal node with a second voltage;

at least one inverter circuit adapted to change state at a threshold voltage of said first internal node, said at least one inverter circuit having an inverter circuit output; and a current injection circuit responsive to said at least one inverter circuit for injecting bootstrap current into said first internal node until said second voltage reaches said threshold voltage, said current injection circuit further comprises a depletion field effect transistor (FET) having a source terminal connected to said inverter circuit output, and first and second p-channel field effect transistors (PFETs) having respective gate terminals tied together at a drain terminal of said depletion FET, and wherein a drain terminal of said second PFET is connected to said first internal node to provide said bootstrap current.

12. The bandgap reference generator of claim 11, wherein said current injection circuit is operative to inject said bootstrap current into said first internal node during an initial condition of said bandgap reference circuit to cause said bandgap reference circuit to quickly transition to a desired operating state and to discontinue injection of said bootstrap current when said second voltage reaches said threshold voltage reflecting that said desired operating state is achieved.

13. The bandgap reference generator of claim 11, wherein said bandgap reference circuit further includes two n-channel field effect transistors (NFETs) and two p-channel field effect transistors (PFETs), and wherein said two NFETs have respective gate terminals tied together at said first internal node and said two PFETs have respective gate terminals tied together at said second internal node.

14. The bandgap reference generator of claim 11, wherein said bandgap reference circuit includes multiple current paths, and wherein said first internal node is disposed on a first current path of said multiple current paths and said second internal node is disposed on a second current path of said multiple current paths.

15. The bandgap reference generator of claim 11, wherein said at least one inverter circuit further comprises a first n-channel field effect transistor (NFET) and a first p-channel field effect transistor (PFET) having respective gate terminals tied together at said second internal node and respective drain terminals tied together at a first inverter output.

16. The bandgap reference generator of claim 15, wherein said at least one inverter circuit further comprises a second n-channel field effect transistor (NFET) and a second p-channel field effect transistor (PFET) having respective gate terminals tied together at said first inverter output and respective drain terminals tied together at a second inverter output, said second inverter output providing said inverter circuit output.

17. The bandgap reference generator of claim 11, wherein said depletion FET further comprises an n-channel depletion FET.

18. The bandgap reference generator of claim 17, wherein a gate terminal of said depletion FET is connected to ground.

19. A method for operating a bandgap reference generator having an input for receiving a supply voltage $V_{CC}$ and an output for providing a reference voltage $V_{REF}$, said bandgap reference circuit also having a first internal node with a first voltage and a second internal node with a second voltage, said method comprising the steps of:

providing said supply voltage $V_{CC}$ to said input of said bandgap reference circuit;

sensing said second voltage at said second internal node of said bandgap reference circuit;

injecting bootstrap current into said first internal node of said bandgap reference circuit causing said bandgap reference circuit to quickly transition to a desired operating state; and discontinuing injection of said bootstrap current when said second voltage reaches a threshold voltage reflecting that said desired operating state is achieved.

20. The method of claim 19, wherein said sensing step further comprises providing at least one inverter circuit adapted to change state at said threshold voltage.

21. The method of claim 20, wherein said at least one inverter circuit further comprises an n-channel field effect transistor (NFET) and a p-channel field effect transistor (PFET) having respective gate terminals tied together at said second internal node and respective drain terminals tied together at said first inverter output, and wherein said sensing step further comprises selecting absolute and relative sizes of said NFET and said PFET.

22. The method of claim 20, wherein said injecting step further comprises providing a current injection circuit for injecting said bootstrap current into said first internal node until said second voltage reaches a threshold voltage.

23. The method of claim 22, wherein said current injection circuit further comprises a depletion field effect transistor (FET) having a source terminal connected to an output of said at least one inverter circuit, and first and second p-channel field effect transistors (PFETs) having respective gate terminals tied together at a drain terminal of said depletion FET, and a drain terminal of said second PFET is connected to said first internal node to provide said bootstrap current, wherein said injecting step further comprises providing a ground potential to said source terminal of said depletion FET.

* * * * *